US008977161B2

(12) United States Patent
Tsuchiya

(10) Patent No.: US 8,977,161 B2
(45) Date of Patent: Mar. 10, 2015

(54) IMAGE FORMING APPARATUS AND LIGHT SCANNING DEVICE

(71) Applicant: Kyocera Document Solutions Inc., Osaka (JP)

(72) Inventor: Hiroaki Tsuchiya, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 25 days.

(21) Appl. No.: 13/765,784

(22) Filed: Feb. 13, 2013

(65) Prior Publication Data

US 2013/0209135 A1 Aug. 15, 2013

(30) Foreign Application Priority Data

Feb. 14, 2012 (JP) ..... 2012-029333

(51) Int. Cl.
*G03G 15/00* (2006.01)
*G03G 21/16* (2006.01)
*G03G 15/04* (2006.01)

(52) U.S. Cl.
CPC ..... *G03G 21/1666* (2013.01); *G03G 15/04045* (2013.01)
USPC ..... 399/107; 399/4; 399/32; 399/118; 399/177

(58) Field of Classification Search
USPC ..... 399/4, 32, 107, 110, 115, 118, 128, 399/153, 177, 178
See application file for complete search history.

(56) References Cited

U.S. PATENT DOCUMENTS

| | | | | |
|---|---|---|---|---|
| 4,708,455 | A * | 11/1987 | Kubota et al. | 399/111 |
| 5,001,516 | A * | 3/1991 | Maruyama et al. | 399/90 |
| 7,446,910 | B2 * | 11/2008 | Tamaru | 358/474 |
| 7,705,871 | B2 * | 4/2010 | Imamura et al. | 347/242 |
| 2007/0139745 | A1 | 6/2007 | Shoji et al. | |
| 2008/0069585 | A1 * | 3/2008 | Amada | 399/94 |

FOREIGN PATENT DOCUMENTS

| | | |
|---|---|---|
| JP | 62-081651 | 4/1987 |
| JP | 11-014925 | 1/1999 |
| JP | 11-202243 | 7/1999 |
| JP | 11-309900 | 11/1999 |
| JP | 2006-113596 | 4/2006 |
| JP | 2007-164048 | 6/2007 |

* cited by examiner

*Primary Examiner* — Francis Gray
(74) *Attorney, Agent, or Firm* — K&L Gates LLP

(57) ABSTRACT

An image forming apparatus includes an image bearing member, an exposure unit, and a main housing. An electrostatic latent image is formed on the image bearing member. The exposure unit includes an optical device that irradiates the image bearing member with light to form the electrostatic latent image, and a housing that defines a storage space in which the optical device is located. The main housing includes a partition wall that divides an inner space of the main housing into a first space in which the image bearing member is located and a second space in which the exposure unit is located. The housing includes a first opening wall having a first opening through which the storage space communicates with the second space. The optical device irradiates the image bearing member with light through the first opening.

7 Claims, 8 Drawing Sheets

IMAGE FORMING APPARATUS AND LIGHT SCANNING DEVICE

INCORPORATION BY REFERENCE

This application is based upon, and claims the benefit of priority from the corresponding Japanese Patent Application No. 2012-029333, filed in the Japan Patent Office on Feb. 14, 2012, the entire contents of which are incorporated herein by reference.

BACKGROUND

This disclosure relates to an image forming apparatus that forms an image on a sheet and to a light scanning device that scans an object to be scanned with light.

Image forming apparatuses, such as printers and copiers, often have an image bearing member that has an image to be transferred to a sheet, and an exposure unit that irradiates the image bearing member with light to form an electrostatic latent image thereon. High-speed image forming is achieved by making the exposure unit form an electrostatic latent image on the image bearing member at high speeds.

A typical exposure unit includes a housing and various optical elements accommodated in the housing. Such optical elements include, for example, a light-emitting element that emits light to form an electrostatic latent image and a rotating mirror that scans the image bearing member with light. Due to the emission of light from the light-emitting element and rotation of the rotating mirror, heat is generated and stays in the housing.

Because, as mentioned above, the exposure unit includes various optical elements, the housing of the exposure unit needs to be highly dustproof. Thus, the housing has a sealed structure. However, such a sealed structure encourages the heat to stay in the housing. Deformation of the housing due to the heat may change the optical settings of optical elements in the housing. Hence, it is preferable to use a resin having high heat resistance as the resin constituting the housing. In this case, the housing of the exposure unit may be relatively expensive. In particular, when the rotating mirror in the exposure unit is operated at high speed to increase the image-forming speed, the amount of heat accumulated in the housing may increase. Thus, the housing may be made from a resin having greater heat resistance. Consequently, an increase in the maximum image-forming speed achieved by an image forming apparatus (hereinbelow, "maximum image-forming speed") may cause an increase in cost of the housing.

A reduction in size of the housing of the exposure unit may reduce the cost of the materials of the housing. However, such a reduction in size of the housing can further encourage the heat to stay in the housing.

Most optical elements in the exposure unit are made from an optical resin. Hence, the optical elements in the exposure unit may be made from a highly heat resistant optical resin, taking into consideration the heat accumulated in the housing. Therefore, an increase in image-forming speed may cause an increase in cost of the optical elements, as therefore the housing.

The relationship between the image-forming speed and the cost of material of the exposure unit, as described above, may be an obstacle to increasing the maximum image-forming speed.

SUMMARY

An image forming apparatus according to an embodiment of this disclosure includes an image bearing member, an exposure unit, and a main housing. An electrostatic latent image is formed on the image bearing member. The exposure unit includes an optical device that irradiates the image bearing member with light to form the electrostatic latent image, and a housing that defines a storage space in which the optical device is located. The main housing includes a partition wall that divides an inner space of the main housing into a first space, in which the image bearing member is located, and a second space in which the exposure unit is located. The housing includes a first opening wall having a first opening through which the storage space communicates with the second space. The optical device irradiates the image bearing member with light through the first opening.

A light scanning device according to another embodiment of this disclosure includes an optical device, a housing, and a main housing. The optical device scans an object to be scanned with light. The housing defines a storage space in which the optical device is located. The main housing includes a partition wall that creates an inner space in which the optical device and the housing are located and an another space. The housing includes an opening wall having an opening through which the storage space communicates with the space in which the optical device is located. The optical device irradiates the object to be scanned with light through the opening.

Additional features and advantages are described herein, and will be apparent from the following Detailed Description and the figures.

DETAILED DESCRIPTION

Referring to the attached drawings, an example image forming apparatus will be described below. Note that terms representing directions, such as upper, lower, left, and right, are intended to help clarify the descriptions. The drawings and the details of the description given below are not limiting the configuration of the image forming apparatus and light scanning device.

Figure 1:
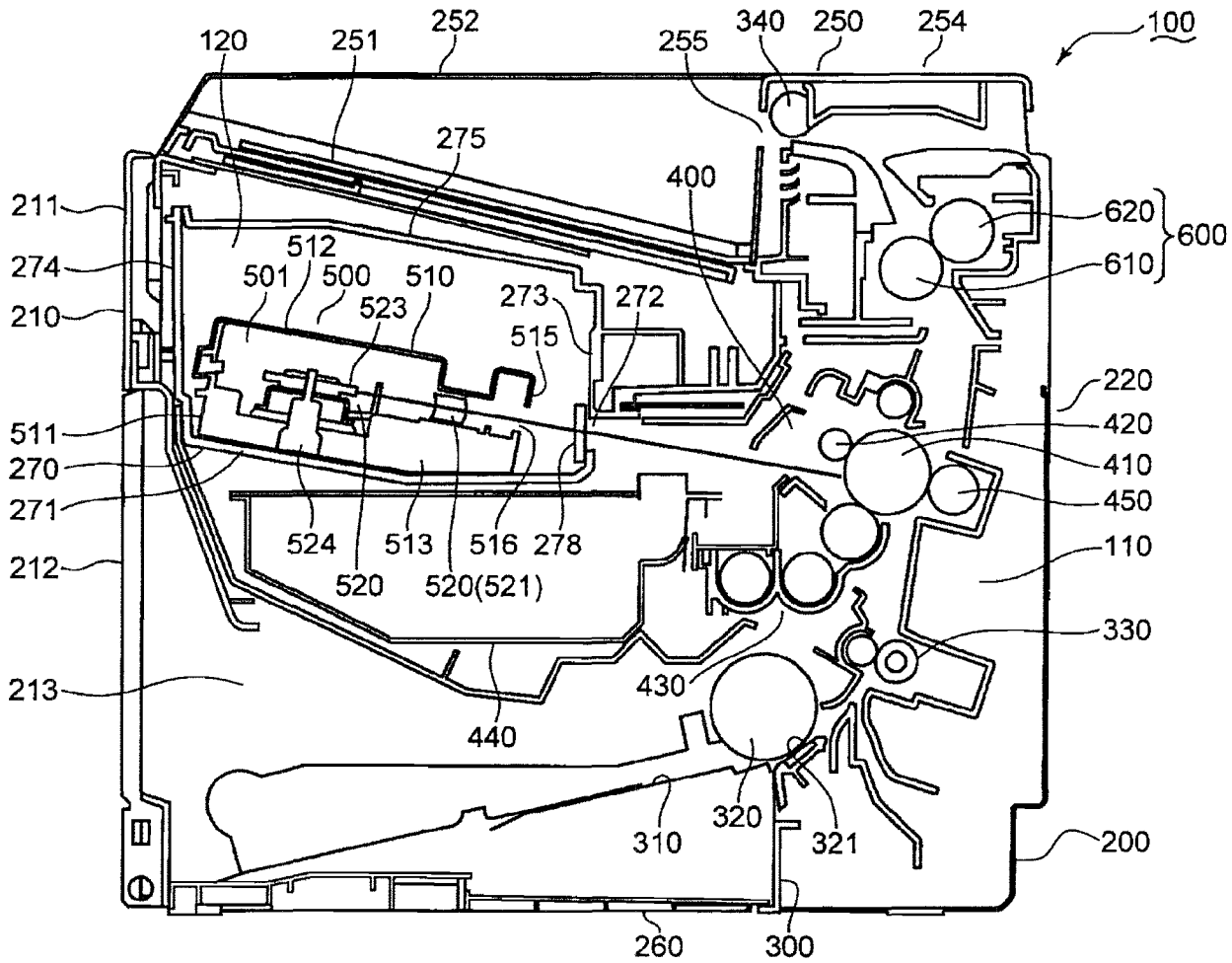
FIG. 1 is a schematic cross-sectional view of a printer, which is an example of an image forming apparatus.
Figure 2:
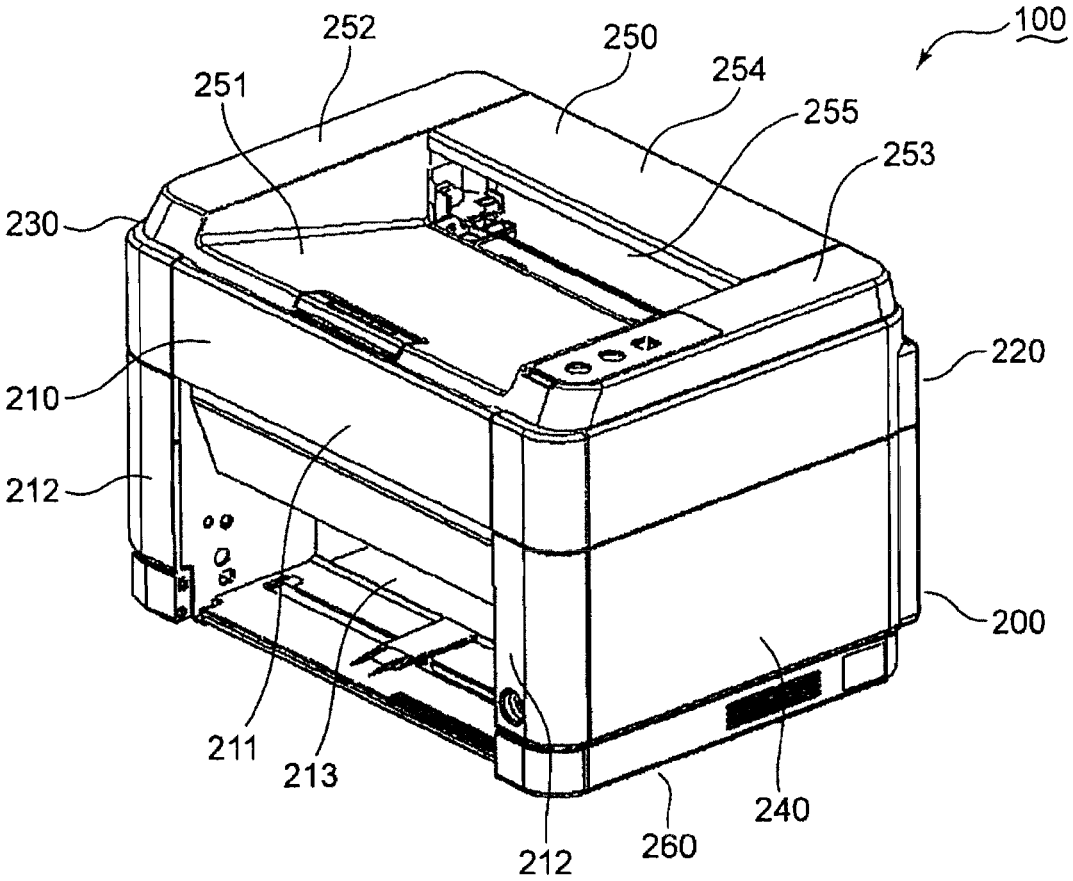
FIG. 2 is a schematic perspective view of an embodiment of a printer.

FIG. 1 is a schematic cross-sectional view of a printer 100, which is an example of an image forming apparatus. FIG. 2 is a schematic perspective view of the printer 100. The printer 100 will be described with reference to FIGS. 1 and 2.

The printer 100 includes a rectangular box-shaped main housing 200. The main housing 200 accommodates various units for forming an image (described below).

The main housing 200 includes a front wall 210 that stands upright, a back wall 220 opposite the front wall 210, a left wall 230 that stands upright between the front wall 210 and the back wall 220, and a right wall 240 opposite the left wall 230. The main housing 200 further includes an upper wall 250 that closes an area enclosed by the upper edges of the front wall 210, back wall 220, left wall 230, and right wall 240, and a lower wall 260 opposite the upper wall 250.

The front wall 210 includes a front cover 211 provided adjacent to the front edge of the upper wall 250, and upright plates 212 provided on the left and right sides of the front cover 211. The front cover 211 horizontally extends along the front edge of the upper wall 250. The upright plates 212 vertically extend downwardly from the front edge of the upper wall 250. Hence, the front wall 210 has a gate shape, defining an opening 213 at a lower part of the main housing 200.

The printer 100 includes a cassette 300 that stores sheets. The cassette 300 is inserted into the main housing 200 from the opening 213 defined by the front wall 210.

The cassette 300 includes a lift plate 310 that supports the sheets. The lift plate 310 raises the leading edges of the sheets.

The printer 100 includes a sheet-feed roller 320 that is in contact with the leading edge of the sheets raised by the lift plate 310, and a separation plate 321 located adjacent to the sheet-feed roller 320. The sheet-feed roller 320 is rotated such that it picks up a sheet from the cassette 300. The separation plate 321 applies friction to a lower surface of the sheet. When the sheet-feed roller 320 picks up several sheets from the cassette 300, the sheets are separated by the friction applied by the separation plate 321. When the sheet-feed roller 320 picks up a sheet from the cassette 300, the sheet-feed roller 320 feeds the sheet downstream in a sheet feeding direction by overcoming the friction applied by the separation plate 321. Thus, the sheets are fed downstream in the sheet feeding direction one at a time. The sheets are then transported upward along a transport path formed along the back wall 220 of the main housing 200.

The printer 100 further includes a registration roller pair 330 that receives the sheet fed from the sheet-feed roller 320, and an image forming section 400 that forms an image on the sheet. The registration roller pair 330 feeds the sheet to the image forming section 400, in synchronization with an image forming process (described below) that is performed by the image forming section 400.

The image forming section 400 includes a photoconductive drum 410 on which an electrostatic latent image and a toner image are formed, a charger 420 that uniformly charges the circumferential surface of the photoconductive drum 410, and an exposure unit 500 that irradiates the charged circumferential surface of the photoconductive drum 410 with a laser beam. As the photoconductive drum 410 rotates, an electrostatic latent image is formed on the photoconductive drum 410, and subsequently, a toner image is formed on the photoconductive drum 410. The toner image is eventually transferred to the sheet fed by the registration roller pair 330.

The printer 100 receives image data from an external device (for example, a personal computer (not shown)). The exposure unit 500 scans the circumferential surface of the photoconductive drum 410 with a laser beam, based on the image data. As a result, an electrostatic latent image, corresponding to the image data, is formed on the circumferential surface of the photoconductive drum 410. The photoconductive drum 410 is an example of an image bearing member. The image bearing member is an example of an object to be scanned.

The image forming section 400 also includes a developing unit 430 that supplies toner to the circumferential surface of the photoconductive drum 410 on which the electrostatic latent image is formed, and a toner container 440 that supplies toner to the developing unit 430. Due to the supply of the toner from the developing unit 430, the toner image corresponding to the electrostatic latent image is formed on the circumferential surface of the photoconductive drum 410. The toner is supplied from the toner container 440 to the developing unit 430 as necessary, so that there is enough toner in the developing unit 430.

The image forming section 400 also includes a transfer roller 450 that receives the sheet fed from the registration roller pair 330, in cooperation with the photoconductive drum 410. While the sheet passes between the photoconductive drum 410 and the transfer roller 450, the transfer roller 450 attracts the toner image on the circumferential surface of the photoconductive drum 410 to the sheet. Thus, the toner image is transferred to the sheet. The photoconductive drum 410 and the transfer roller 450 feed the sheet upward.

The printer 100 further includes a fixing unit 600 that fixes the toner image to the sheet. The fixing unit 600 includes a heating roller 610 that generates heat to fuse the toner on the sheet, and a pressure roller 620 that presses the surface of the sheet provided with the toner image onto the heating roller 610. The sheet leaving the photoconductive drum 410 and the transfer roller 450 passes between the heating roller 610 and the pressure roller 620, during which the toner fused by the heating roller 610 permeates into the sheet, and the toner image is fixed to the sheet. Then, the fixing unit 600 sends the sheet upwardly.

The printer 100 includes a sheet-output roller 340. The fixing unit 600 sends the sheet to the sheet-output roller 340. The sheet-output roller 340 outputs the sheet outside from the inside of the main housing 200.

The upper wall 250 of the main housing 200 includes a sheet-output portion 251 that receives the sheet output from the main housing 200 by the sheet-output roller 340. The sheet-output portion 251 includes an inclined surface extending downward from the upper edge of the front wall 210.

The upper wall 250 also includes a left rib wall 252 protruding upwardly on the left side of the sheet-output portion 251, a right rib wall 253 protruding upwardly on the right side of the sheet-output portion 251, and a top plate 254 extending between the left rib wall 252 and the right rib wall 253 along the upper edge of the back wall 220. An output port 255, through which the sheet is outputted, is located between the top plate 254 and the sheet-output portion 251. The sheet-output portion 251, the top plate 254, the left rib wall 252, and the right rib wall 253 define a concave portion in which sheets fed from the output port 255 are stacked. In this embodiment, the sheet-output portion 251, the left rib wall 252, and the right rib wall 253 are integrally formed.

Figure 3:
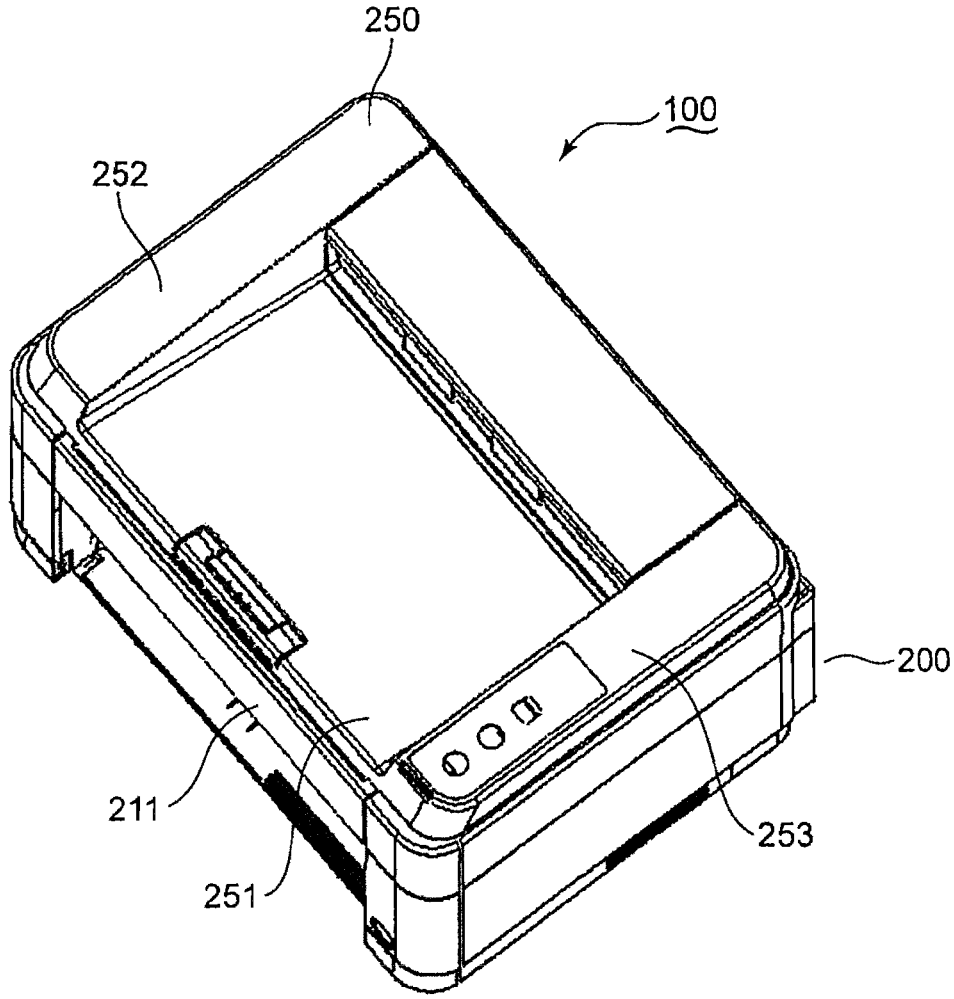
FIG. 3 is a schematic perspective view of an upper part of the printer.
Figure 4:
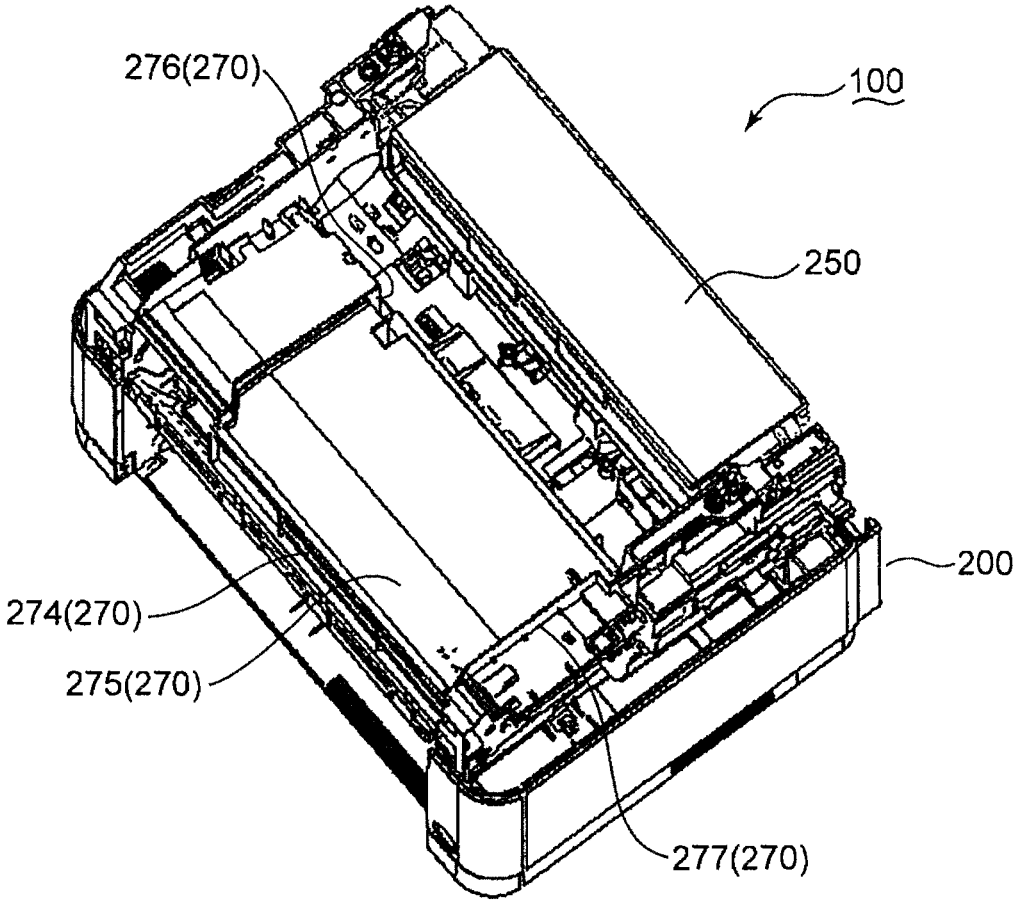
FIG. 4 is a schematic perspective view of the upper part of the printer without a front cover, a sheet-output portion, a left rib wall, and a right rib wall.

FIGS. 3 and 4 are schematic perspective views of the printer 100. Referring to FIGS. 1, 3, and 4, the main housing 200 will be described. FIG. 3 mainly shows the upper wall 250 of the main housing 200. FIG. 4 shows the printer 100 without the front cover 211, the sheet-output portion 251, the left rib wall 252, and the right rib wall 253.

As illustrated in FIG. 1, the main housing 200 includes an inner wall 270 that divides the inner space into a space where the exposure unit 500 is located (hereinbelow, "second space 120") and a space in which the other devices for forming an image are located (hereinbelow, "first space 110"). For example, the other devices located in the first space 110 are the cassette 300, the image forming section 400, and the fixing unit 600. The inner wall 270 is an example of a partition wall.

When the cassette 300 is inserted into the main housing 200, dust may enter the first space 110. Because the inner wall 270 separates the second space 120 and the first space 110, the exposure unit 500 in the second space 120 is appropriately protected from the dust floating in the first space 110. In other words, the inner wall 270 blocks the dust.

The inner wall 270 includes a support plate 271 that supports the exposure unit 500, an open plate 273 having an opening 272 through which a laser beam emitted from the exposure unit 500 passes, a standing plate 274 that stands upright between the exposure unit 500 and the front cover 211, and an upper plate 275 that covers the opening between the upper edges of the open plate 273 and the standing plate 274. The laser beam emitted from the exposure unit 500 passes through the opening 272 and travels to the photoconductive drum 410. The opening 272 is an example of a second opening. The open plate 273 is an example of a second opening wall.

As illustrated in FIGS. 3 and 4, the front cover 211, the sheet-output portion 251, the left rib wall 252, and the right rib wall 253 are removable from the printer 100. When the front cover 211, the sheet-output portion 251, the left rib wall 252, and the right rib wall 253 are removed from the printer 100, the upper plate 275 of the inner wall 270 is exposed.

Figure 5:
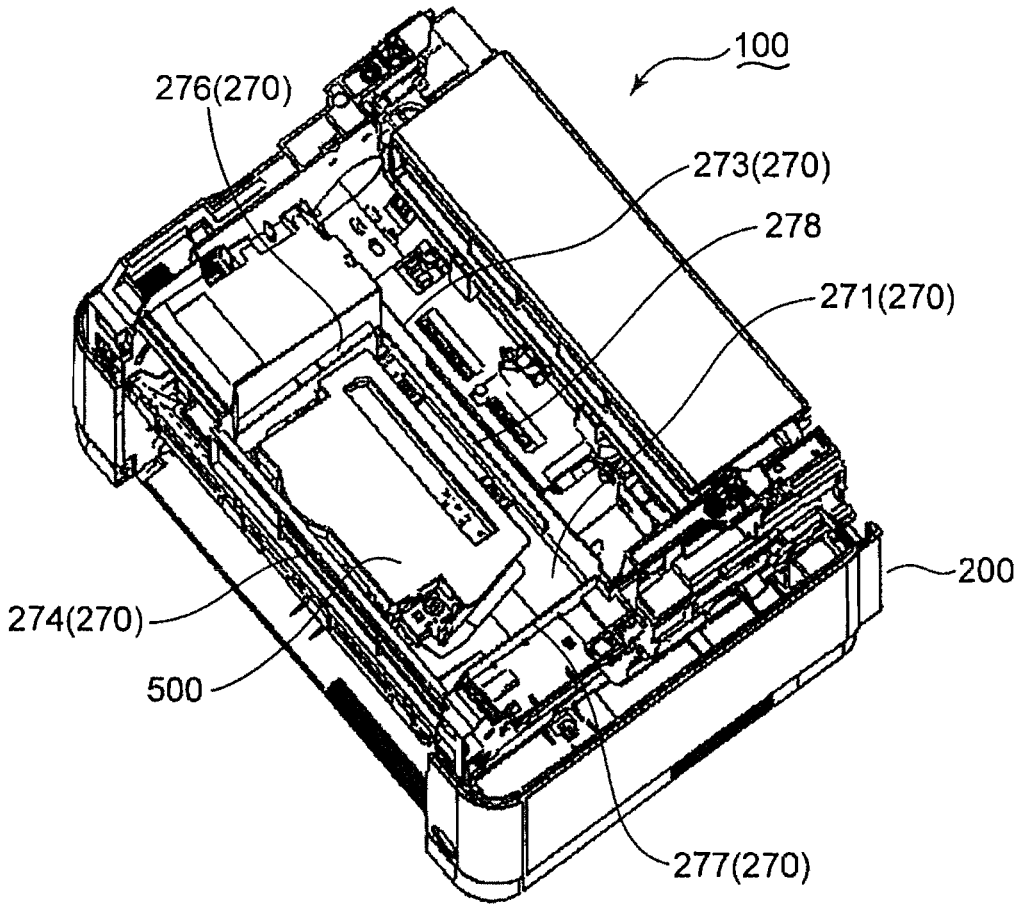
FIG. 5 is a schematic perspective view of the upper part of the printer without the front cover, the sheet-output portion, the left rib wall, the right rib wall, and an upper plate.
Figure 6:
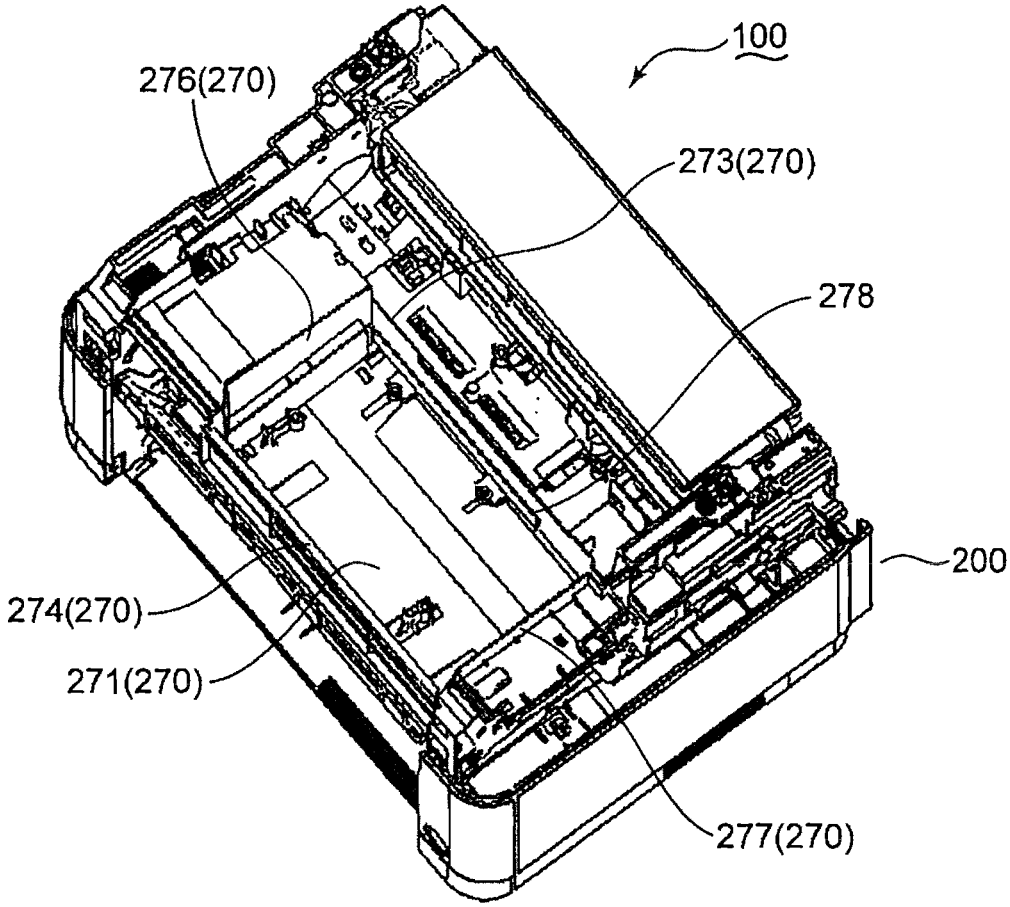
FIG. 6 is a schematic perspective view of the upper part of the printer without the front cover, the sheet-output portion, the left rib wall, the right rib wall, the upper plate, and an exposure unit.

FIGS. 5 and 6 are schematic perspective views of the upper part of the printer 100. Referring to FIGS. 1 and 4 to 6, the main housing 200 will be described in more detail. FIG. 5 shows the printer 100 without the front cover 211, the sheet-output portion 251, the left rib wall 252, the right rib wall 253, and the upper plate 275. FIG. 6 shows the printer 100 without the front cover 211, the sheet-output portion 251, the left rib wall 252, the right rib wall 253, the upper plate 275, and the exposure unit 500.

As illustrated in FIGS. 5 and 6, the inner wall 270 includes a left plate 276 that stands upright from the support plate 271 on the left side of the exposure unit 500, and a right plate 277 that stands upright from the support plate 271 on the right side of the exposure unit 500. Unlike the open plate 273, no opening is formed in the support plate 271, the standing plate 274, the upper plate 275, the left plate 276, or the right plate 277. Therefore, the support plate 271, the standing plate 274, the upper plate 275, the left plate 276, and the right plate 277 completely separate the first space 110 from the second space 120. The support plate 271, the standing plate 274, the upper plate 275, the left plate 276, and the right plate 277 are an example of a second closing wall.

As illustrated in FIG. 1, the main housing 200 further includes a dustproof glass member 278 that closes the opening 272. Thus, the second space 120 is completely separated from the first space 110. Instead of the dustproof glass member 278, another closing member that prevents dust floating in the first space 110 from entering the second space 120 may be attached to the open plate 273 so as to close the opening 272.

Figure 7:
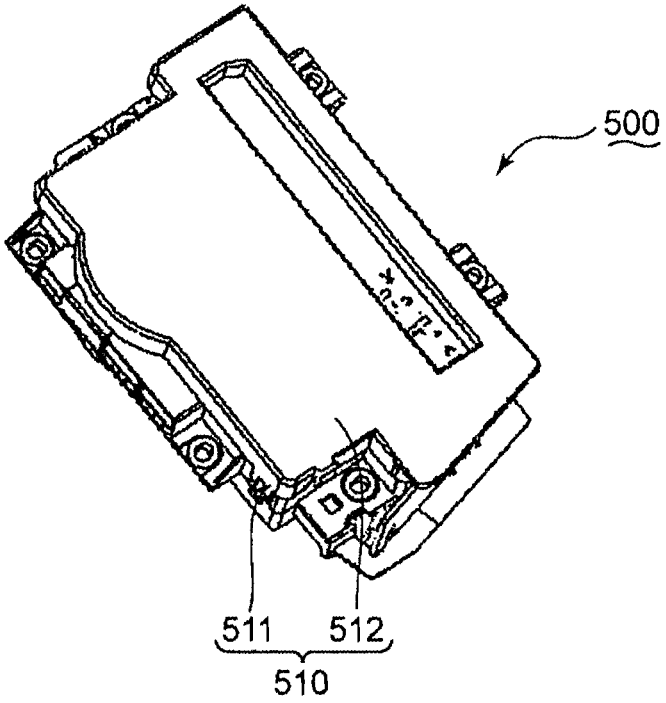
FIG. 7 is a schematic perspective view of the exposure unit.

FIG. 7 is a schematic perspective view of the exposure unit 500. Referring to FIGS. 1 and 7, the exposure unit 500 will be described.

As illustrated in FIG. 1, the exposure unit 500 includes a housing 510. The housing 510 defines a storage space 501 in which the optical device 520 is located. In other words, the housing 510 has a storage space 501 therein. The optical device 520 irradiates the photoconductive drum 410 with a laser beam to form an electrostatic latent image.

As illustrated in FIG. 7, the housing 510 includes an open-top box member 511 and a lid member 512 to close the opening in the box member 511.

Figure 8:
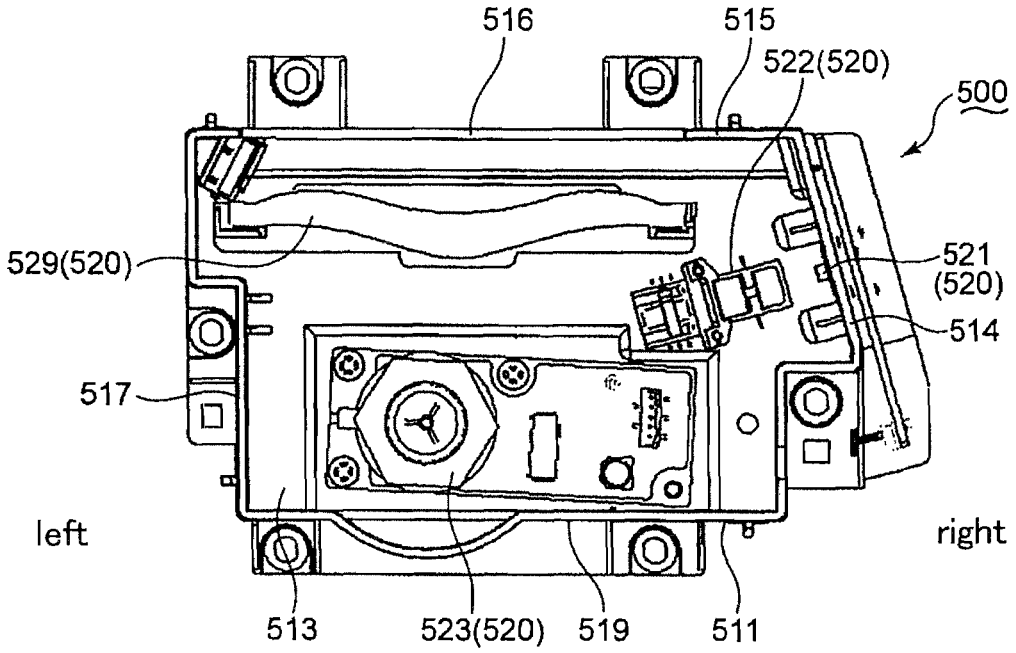
FIG. 8 is a schematic plan view of the exposure unit.

FIG. 8 is a schematic plan view of the exposure unit 500. Referring to FIGS. 1 and 8, the exposure unit 500 will be described in more detail. FIG. 8 shows the exposure unit 500 without the lid member 512.

As illustrated in FIG. 8, the optical device 520 includes a laser light source 521 that emits a laser beam, an optical element group 522 that adjusts the properties of the laser beam (for example, the beam diameter), and a polygon mirror 523 that receives the laser beam passing through the optical element group 522. The laser light source 521 emits a laser beam toward the polygon mirror 523. The laser light source 521 is an example of the light source.

As illustrated in FIG. 1, the optical device 520 also includes a motor 524 that rotates the polygon mirror 523. Due to rotation of the polygon mirror 523, the laser beam is deflected toward the photoconductive drum 410. Due to rotation of the polygon mirror 523, the photoconductive drum 410 is scanned with a laser beam moved in the left-right direction in FIG. 8. The motor 524 causes the polygon mirror 523 to rotate at a high speed. This causes the motor 524 to generate heat. Thus, the motor 524 serves as a heat source. As will be described below, in this embodiment, accumulation of heat generated by the heat source (for example, the motor 524) in the storage space 501 is appropriately suppressed. The polygon mirror 523 and the motor 524 are an example of a deflection element.

As illustrated in FIG. 8, the optical device 520 includes an fθ lens 529 extending in the left-right direction. The fθ lens 529 receives the laser beam deflected by the polygon mirror 523 and forms an image on the circumferential surface of the photoconductive drum 410. The fθ lens 529 is an example of an imaging lens.

The box member 511 includes a first support plate 513, which supports the optical element group 522, the polygon mirror 523, the motor 524, and the fθ lens 529, and a second support plate 514, which supports the laser light source 521. The box member 511 also includes an open plate 515 facing the fθ lens 529. The open plate 515 has an opening 516 through which a laser beam moved in the left-right direction in FIG. 8 can pass. The laser beam emitted toward the second space 120 through the opening 516 passes through the transparent dustproof glass member 278 attached so as to close the opening 272 and travels to the circumferential surface of the photoconductive drum 410.

The storage space 501 communicates with the second space 120 through the opening 516. Thus, air in the storage space 501 can flow into the second space 120, and air in the second space 120 can flow into the storage space 501; that is, air may be exchanged between the storage space 501 and the second space 120. Opening 516 is an example of a first opening. Open plate 515 is an example of a first opening wall.

The box member 511 further includes a first facing plate 519 facing the open plate 515, and a second facing plate 517 facing the second support plate 514. Unlike the open plate 515, no opening is formed in the first facing plate 519, the second facing plate 517, the first support plate 513, the second support plate 514, or the lid member 512. Therefore, the first facing plate 519, the second facing plate 517, the first support plate 513, the second support plate 514, and the lid member 512 completely separate the storage space 501 from the second space 120. The first facing plate 519, the second facing plate 517, the first support plate 513, the second support plate 514, and the lid member 512 are an example of a first closing wall.

As described above, air is exchanged between the storage space 501 and the second space 120 through the opening 516. Thus, heat generated by the motor 524 may be released from the storage space 501 to the second space 120. Therefore, the accumulation of heat in the storage space 501 is prevented.

As described above, the polygon mirror 523 is rotated in the storage space 501. The rotation of the polygon mirror 523 may facilitate exchange of air between the storage space 501 and the second space 120. Therefore, accumulation of heat in the storage space 501 is further relieved.

As described above, dust may enter the first space 110 of the main housing 200. However, because the inner wall 270 separates between the second space 120 and the first space 110, the exposure unit 500 in the second space 120 is protected from the dust floating in the first space 110.

Accordingly, the printer 100 can protect the optical device 520 of the exposure unit 500 from dust. Furthermore, the printer 100 can increase the maximum image-forming speed achieved by the printer 100, without requiring the housing 510 of the exposure unit 500 and the optical device 520 in the housing 510 to have excessively high heat resistance. Furthermore, using the printer 100, the housing 510 of the exposure unit 500 may be reduced in size.

It is desirable that the second space 120 have a capacity that is at least 1.5 times as large as that of the storage space 501. The inventor observed no marked increase in temperature inside the storage space 501 while the polygon mirror 523 was rotated by the motor 524 and the motor 524 was generating heat, when the second space 120 has a capacity at least 1.5 times as large as that of the storage space 501.

The provision of the dustproof glass member 278 is optional. As long as the distance between the opening 516 provided in the open plate 515 of the exposure unit 500 and the opening 272 provided in the open plate 273 of the inner wall 270 is large enough, the air existing between the open plates 515 and 273 prevents the air inside the first space 110 from flowing into the storage space 501. The inventor found that, even if the opening 272 is not covered by a closing member, such as the dustproof glass member 278, entrance of dust into the storage space 501 is almost completely prevented using a distance of at least 1 cm between the open plates 515 and 273.

Although the printer has been described as an example of an image forming apparatus in the embodiment of this disclosure, the spirit of this disclosure may also be applied to other image forming apparatuses, such as copiers and multifunction peripherals, and light scanning devices, such as projectors, which scan an object to be scanned (e.g., a screen) with light.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image forming apparatus comprising:

an image bearing member on which an electrostatic latent image is formed;

an exposure unit including an optical device that irradiates the image bearing member with light to form the electrostatic latent image, a casing that defines a storage space in which the optical device is located, and a polygon mirror; and a main housing including a partition wall that divides an inner space of the main housing into a first space in which the image bearing member is located and a second space in which the exposure unit is located, wherein the casing includes a first opening wall having a first opening through which the storage space communicates with the second space, wherein the optical device irradiates the image bearing member with light through the first opening, wherein air in the storage space can flow into the second space, and air in the second space can flow into the storage space, wherein rotation of the polygon mirror facilitates exchange of air between the storage space and the second space, wherein the partition wall includes a second opening wall having a second opening, wherein the light emitted through the first opening travels to the image bearing member through the second opening, wherein the main housing includes a closing member that closes the second opening, wherein the second space is a sealed space protected from dust floating in the first space, and wherein the second space has a capacity that is at least 1.5 times as large as that of the storage space.

2. The image forming apparatus according to claim 1, wherein the closing member is a dustproof glass member.

3. The image forming apparatus according to claim 1, wherein the second opening wall is located at a certain distance away from the first opening wall so that air existing between the first opening wall and the second opening wall prevents air in the first space from flowing into the storage space.

4. The image forming apparatus according to claim 1, wherein the second opening wall is located at a distance of at least 1 cm away from the first opening wall.

5. The image forming apparatus according to claim 1, wherein the casing includes a first closing wall that separates between the second space and the storage space and the first opening wall.

6. The image forming apparatus according to claim 1, wherein the partition wall includes a second closing wall that separates between the first space and the second space and the second opening wall.

7. The image forming apparatus according to claim 1, wherein the optical device includes a light source that emits light, a deflection element that deflects light emitted from the light source, and an image-forming element that forms an image of the light emitted from the deflection element on the image bearing member.

* * * * *